United States Patent [19]

Hergaux

[11] 4,234,096

[45] Nov. 18, 1980

[54] COVER FOR WASTE CONTAINER

[76] Inventor: Claude Hergaux, 6 & 8 Rue de l'Avenir, 76120 LeGrand Quevilly, France

[21] Appl. No.: 36,581

[22] Filed: May 7, 1979

[30] Foreign Application Priority Data

Jul. 24, 1978 [FR] France ..... 78 22065

[51] Int. Cl.[3] ..... B65D 23/00; B65D 43/14; B65D 51/04

[52] U.S. Cl. ..... 220/1 T; 220/334

[58] Field of Search ..... 220/1 T, 334

[56] References Cited

U.S. PATENT DOCUMENTS

| | | | |
|---|---|---|---|
| 3,394,832 | 7/1968 | McAllister et al. | 220/1 T |
| 4,126,241 | 11/1978 | Klosk | 220/1 T |

*Primary Examiner*—George T. Hall

[57] ABSTRACT

A cover for a box-like, generally rectangular, waste storage and transport container. The cover comprises a truncated pyramid having a square base, a center of symmetry and two perpendicular axes of symmetry passing through the center. One side of the truncated pyramid is formed with a hingeable door, which automatically maintains a closed position without any load placed thereon.

5 Claims, 2 Drawing Figures

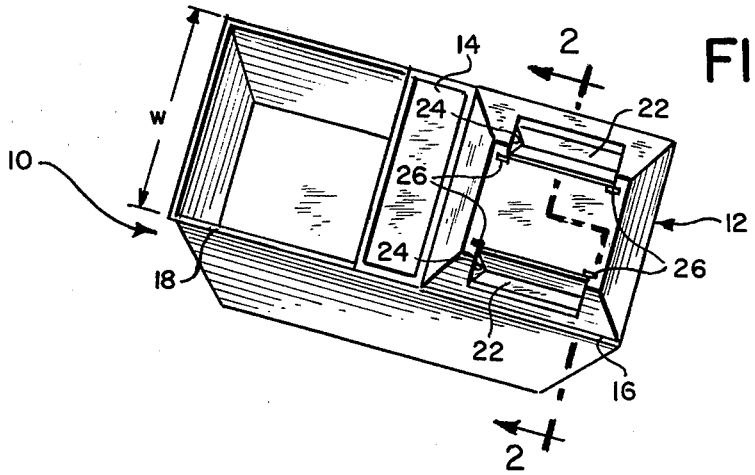
FIG. 1.
FIG. 2.
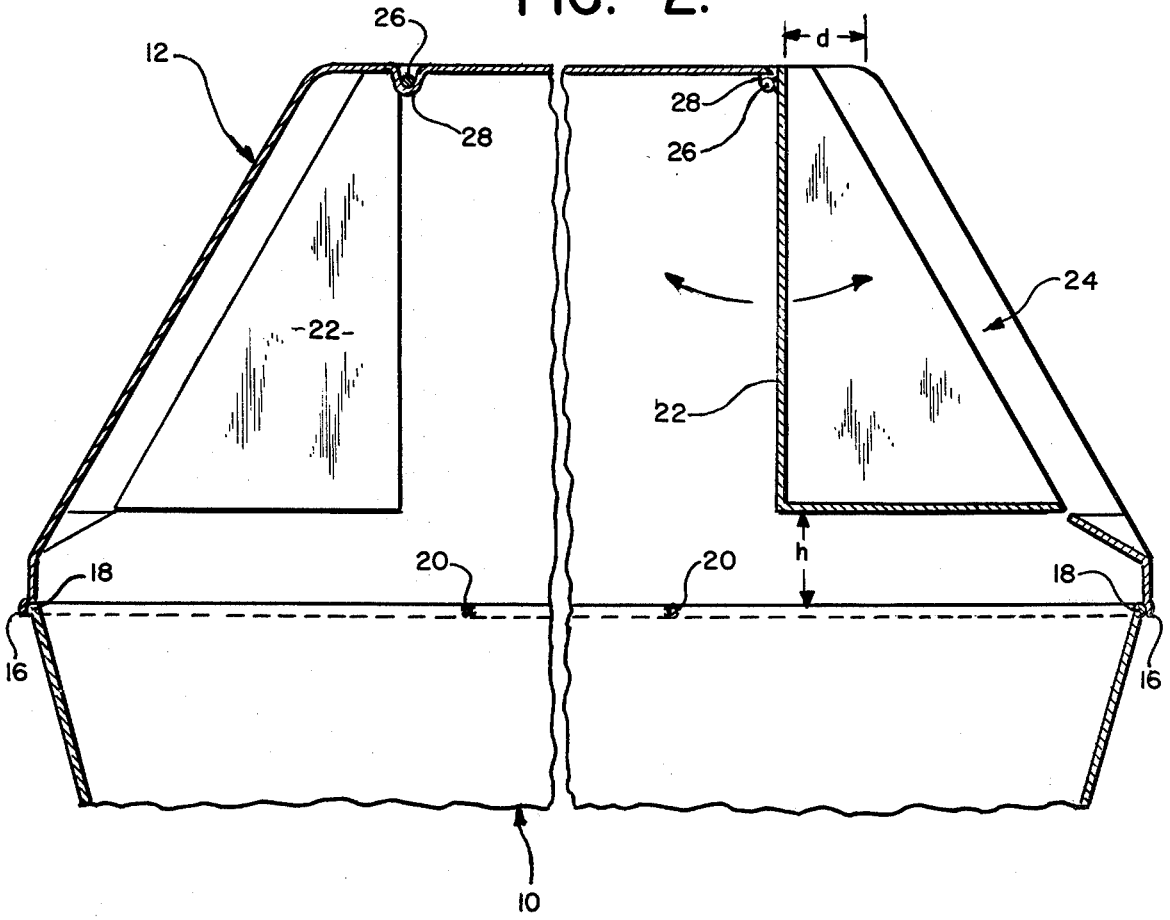

COVER FOR WASTE CONTAINER

BACKGROUND OF THE INVENTION

The present invention relates to containers for the storage and transportation of industrial, household, and commercial waste, in particular, to a cover.

The removal of trash and similar waste materials from industrial, commercial, and domestic establishments has usually been accomplished by the daily collection of such material. The daily collection of such waste usually ties up large numbers of dump trucks, each having relatively large crew. Recently, the tendency has been to provide large containers in reserved spaces where the waste material is collected over a period of time. Each of the containers is then picked up and replaced at fixed intervals. In this way, one truck can transport several containers, and the truck can have a relatively smaller crew. Up till now, the containers have had the serious drawback of allowing odors and dust to escape as well as leaving the waste to the elements. They have also offered temptation, not to say an attraction, to wandering wild animals which forage on the waste contained therein, and thus are often carriers of serious diseases. It has been attempted to overcome this problem by employing plates hinged to the container which form lids over the opening. These plates were heavy metal members and were so large that frequently, once the container was opened, the covers were not replaced or put back into covering position. Further, since these lid plates were hinged to the container directly, they frequently interfered with the collection of the waste, particularly large boxes or other materials that would stick upwardly from the interior of the container. Therefore, the problem of maintaining proper hygienic conditions has not been overcome by the prior art.

It is an object of the present invention to provide the cover for large waste containers which maintain the container closed at all times, i.e., while they are gradually being filled, and while they are being transported.

It is a further object of the present invention to provide a cover of the type described which has a door opening which is automatically closable so that once the insertion is completed, the container is sealed.

The aforegoing objects, advantages as well as other objects and advantages are set forth in the following disclosure of the present invention.

SUMMARY OF THE INVENTION

According to the present invention there is provided a cover for a waste storage and transport container, comprising a truncated pyramid having a square base, having a center of symmetry and two perpendicular axes of symmetry passing throug the center. At least one side of the truncated pyramid is formed with a hingeable door, which automatically maintains a closed position without any load placed thereon.

Preferably, at least one dimension of the square base conforms to the width of the container so that the truncated pyramid will at least be coextensive of this width. Should the length of the container be greater than a multiple of the width of the container, then two or more lids can be used to cover the container. When the length is greater than a multiple, then a container may be provided with spacer members extending across the width of the container so as to reduce the open surface of the container in its length to exact multiples of the width.

Preferably the truncated pyramid cover is provided with at least two openings. Each of the openings are provided with doors which swing into the interior of the cover and are articulated at their top with respect to the cover. Preferably, the doors are formed in the shape of an L which is pivotally connected at the free end of the long leg of the L to the top of the cover so that the long leg normally hangs vertically with respect to the container, the short leg extending outwardly of the cover. In this manner swinging of the cover can be easily accomplished even by loading the horizontal leg with the waste material and the door will swing inwardly toward the container. The door will be automatically turned due to the effect of gravity on the center of gravity of the door itself.

Full details of the present invention are set forth in the following description and are illustrated in the accompanying drawings.

BRIEF DESCRIPTION OF THE DRAWINGS

In the drawings,

FIG. 1 is a perspective view of a container showing the application of a cover thereon; and FIG. 2 is a sectional view taken along lines 2—2 of FIG. 1.

DESCRIPTION OF THE INVENTION

Turning to the drawings, a traditional dumpster container is illustrated by the numeral 10, comprising a generally trapezoidal box with an open rectangular top. The container is generally conventional in nature and is provided with hooks and/or brackets (not shown) by which the same may be grasped, engaged, and otherwise lifted onto a truck, for subsequent dumping of the contents. Such containers are generally placed in reserved areas of industrial, commercial, or household establishments so that waste material may be periodically fed to it and where the container over a period of time is loaded by maintenance persons specifically hired for this purpose or by persons of the general public who may have access thereto.

As seen in FIG. 1, there is mounted on top of the container a cover, generally indicated by the numeral 12, formed as a closed top, open bottom, truncated pyramid having a center of symmetry and two perpendicular axes of symmetry passing through the center. The base of each of the truncated pyramids is, therefore, a square. In the embodiment shown, the length of each side of the square base, is equal to the width w of the container 10. Depending upon the length of the container, the container may be provided with one or more of these covers. When the ratio of the length to the width is not a whole number, the area of the container top can be divided by one or more cross-plates 14 to form an appropriate number of squares conforming to the base of the cover 12. In the illustration, a single cross-plate 14 is provided separating the container into two equal squares. In the event the width is of a size which would require the base to be too large or unwieldy, lateral plates can be provided along the longitudinal edges of the container. This will be generally unnecessary since this is rather simple to provide the length of the base of the truncated pyramid equal the width of the container for most containers.

As seen in FIG. 2, the peripheral edge 16 of the base is provided with a profile lip such as a groove, a continuous bead, or one or more detents and recesses which permit the cover to be easily placed so as to securely rest on the upper edge 18 of the container which may be similarly formed with such conforming profile lip, beads, detents, recesses, etc. To secure the cover firmly to the container, locking pins, latches, or other fastening devices may be employed. Preferably, the simple use of a pin 20 inserted laterally through a hole in the marginal edge of the superimposed cover and container will suffice.

The cover 12 is provided on at least one of its sides with a swinging door 22. To accommodate the door, the particular side is cut out at a height h above the lower base or edge and inwardly into the top by a smaller distance d to provide a suitable opening 24. The door 22 is itself formed of a plate-like member having an L shape, the longer side of which is pivotally mounted at its free end by a suitable hangar 26 to the top of the cover 12. The hangar 26 can be expediently formed of a rod or shaft secured on the upper edge or door and resting within an open-bearing cup or bearing block 28 as seen in FIG. 2. This permits the door the freedom of pivotal movement in the direction shown by the arrows as well as enabling the door to be easily removed when necessary. On the other hand, other more elaborate hinges and similar fastening devices may be employed.

The shorter leg of the door extends horizontally to the vertical leg outwardly of the opening 24, thus establishing a center of gravity which acts to maintain the longer leg normally vertical and biases this leg in this position in the absence of a load thereon. The door, on the other hand, is freely moveable by the exertion of a force from the exterior such as manually or by placing of waste material on the short leg itself. This will change the center of gravity and cause the door to automatically open on the inward direction during the filling of the container. Thus, during filling of the container, the cover need not be removed or bodily lifted from the opening. However, once the trash is inserted through the opening, the door will automatically swing back into its closed position. To ensure that the container is closed completely, the opening 24 into the container is provided with a pair of swidewalls or wings against which the lateral edges of the door slide. If desired, the door may be provided with these side wings rather than the container walls.

By forming the truncated pyramid with the square base, the cover may be placed in any orientation of the longitudinal or transverse sides of the storage container. This enables the cover to be placed with its door along the long side or, alternately, along the short side or end of the container allowing the container to be filled most easily as local conditions demand. Preferably, a pair of doors 22 are provided each located on opposite sides of the container, although placement of the doors on adjacent sides can also be accomplished easily by taking care in the construction of the opening and the dimensions of both the opening and the doors so that they would not interfere with each other.

Since the dumpster containers as conventionally employed throughout the world are of a trapezoidal form, having a rectangular opening, the formation of covers having a square base provides simple and effective means for covering the opening of several varieties at one time. Further, the cover of the present invention will in no way interfere with the size, dimension, and construction of the container itself which is, as is well known, subject to all sorts of local laws and ordinances as to their size, weight, material, and constructional features. Unlike, the lids presently known, the cover of the present invention is not permanently hinged to the upper edge of the container and does not provide a flat, plate-like lid on the container, but enables the formation of an enlarged dome-like structure over the container, thus permitting the insertion of waste material of the large sizes such as boxes, cartons and the like into the container without any difficulty and allows these waste materials to extend above the upper lip of the container itself. By providing the door as an L-shaped articulated member freely moveable under the effect of gravity, automatic opening and closing of the door is effected. Brute strength is not required to open the door or even to close it.

The cover, and the door itself may be formed of sheet metal or of plastic. In particular, plastic is preferable, since it can be easily formed or molded, and is perfectly resistent to corrosion. Plastic is, further, easier to clean. On the other hand, a steel sheet with or without protective coatings such as zinc, lead, or the like may also be used. Because the cover is not normally in contact with the waste or trash, it does not have to be fully protected as would the container itself. The pivotal attachment of the door to the cover can be simply provided. As shown, the use of a shaft may be simple since it may be easily welded, molded or otherwise adhered to the door. In addition to the shaft as described, the upper end of the vertical leg of the door can be provided with laterally extending pins which fit into collars formed in the cover itself, or through bearing bases or the like.

Various embodiments and modifications have been shown and suggested in the foregoing disclosure. Other changes will be obvious to those skilled in the present art. Accordingly, the present disclosure is to be taken as illustrative only and not limiting of the invention.

What is claimed:

1. A cover for a storage and transport container of waste material, comprising a body having a truncated pyramidal shape provided with a center of symmetry and a pair of perpendicular axes of symmetry passing through said center, said body being closed on its top and open at its base, the base being square, at least one side of said body being provided with an opening for introduction of waste, a door mounted within said opening, said door being formed as an L-shaped member, the long leg of which is pivotably secured at its free end to the top of said body and the short leg of which extends outwardly of said opening, said L-shaped member having a center of gravity acting to maintain said longer leg vertical in the absence of a load thereon, whereby said door is biased in normally closed position with respect to said opening and swingable under a load into an open position with respect to said opening.

2. The cover according to claim 1 in combination with a transport container, having a rectangular open top and at least one square opening conforming to the size of the base of said truncated pyramidal cover.

3. The combination according to claim 2, wherein the base and top edges of the container are provided with cooperating means for securing the cover on said base.

4. The combination according to claim 3, including means for locking said cover to said container.

5. The combination according to claims 2, 3 or 4, wherein the top of said container has a length which is a multiple of said cover and is provided with a corresponding number of said covers.

* * * * *